United States Patent [19]

Sharpe et al.

[11] Patent Number: 4,829,902

[45] Date of Patent: May 16, 1989

[54] METHOD FOR CHARGING FLOWABLE EXPLOSIVES INTO UPWARDLY EXTENDING BOREHOLES

[75] Inventors: Kenneth R. Sharpe, Markham; William E. Cribb, Pointe Claire; Melvin McNicol, Otterburn Park; Joseph P. Couture, Beloeil, all of Canada

[73] Assignee: C-I-L Inc., North York, Canada

[21] Appl. No.: 926,653

[22] Filed: Nov. 4, 1986

[30] Foreign Application Priority Data

Jan. 7, 1986 [CA] Canada ..... 499121

[51] Int. Cl.[4] ..... F42D 3/00

[52] U.S. Cl. ..... 102/312; 102/313; 86/20.13

[58] Field of Search ..... 102/312, 313; 86/20.13

[56] References Cited

U.S. PATENT DOCUMENTS

| | | | |
|---|---|---|---|
| 3,111,059 | 11/1963 | Marsh | 86/20.13 X |
| 4,040,355 | 8/1977 | Hopler, Jr. | 102/313 |
| 4,421,004 | 12/1983 | Hallstrom et al. | 86/20.13 |
| 4,485,739 | 12/1984 | Emmett | 102/313 X |
| 4,572,075 | 2/1986 | Day et al. | 102/313 X |
| 4,614,146 | 9/1986 | Ross et al. | 102/313 X |

*Primary Examiner*—Peter A. Nelson

*Attorney, Agent, or Firm*—Donald G. Ballantyne

[57] ABSTRACT

A method is provided for loading upwardly extending boreholes in rock with flowable bulk explosives. An explosives loading pipe, an air exhaust pipe and an initiating booster charge with associated initiator are located in the borehole so that the booster and the pipe ends are located deep within the borehole. The ends of the pipes and the initiator are pressed through one or more channels in a cylindrical plug wedged in the borehole opening. Stemming material is first placed in the borehole through the loading pipe to lie against the plug and thereafter the bulk explosive is introduced to fill the borehole. Entrapped air is exhausted through the exhaust pipe.

7 Claims, 1 Drawing Sheet

METHOD FOR CHARGING FLOWABLE EXPLOSIVES INTO UPWARDLY EXTENDING BOREHOLES

BACKGROUND OF THE INVENTION

1. Field of the Invention

This invention relates to the charging of fluent explosives into upwardly extending boreholes. In particular, a method and apparatus is provided whereby bulk, flowable explosives may be safely and conveniently loaded and retained in boreholes extending upwardly in the rock ceiling or roof of an underground chamber.

In the mining of underground ore bodies, boreholes for the explosive dislodgement of the ore are frequently drilled upward into the ore formation. These upwardly extending boreholes (up-holes) are charged with explosives with great difficulty, especially in chambers having high ceilings. One or more explosive charges in packages are fitted into the mouth of the borehole and, thereafter, lifted and pushed manually by means of a loading pole into the borehole where they must be secured against the force of gravity. Packaged explosive charges, for purposes of economies in many mining operations, have been superceded by explosives in unpackaged or bulk form. These bulk explosives, such as, for example, pulverulent ANFO, water-gel slurries and water-in-oil emulsions, are provided near the blasting site in bulk containers from which they are delivered directly into the boreholes by air-eduction or pumping methods. The loading of these flowable bulk explosives into up-holes has presented particular difficulties for mine operators.

2. Description of the Prior Art

Attempts to charge up-holes with flowable explosives have generally involved the use of an explosive delivery pipe or hose fitted tightly into the borehole and equipped with a valve or other device which prevents flow-back of the fluent explosives from the charged hole. Often special seals are required to provide fluid-tight closure of the boreholes. U.S. Pat. No. 4,036,100 granted June 19, 1977 to E. K. Hurley attempts to provide a simplified and practical means for charging up-holes. However, the method of Hurley has not, to Applicant's knowledge, been adopted commercially. One problem not overcome by the Hurley method is the entrapment of air within the borehole during the loading of the fluent charge. A further solution is offered in U.K. Patent Specification No. 1,393,859 by a method wherein the vicinity of the collar of the borehole is stoppered and a pumpable explosive is introduced into the borehole to occupy the volume of the borehole progressively from the collar to the toe of the hole. In this method, an increasing volume and weight of explosive must be overcome by the pump in order to fill the borehole. Furthermore, a closely-fitted stopper or plug is required to prevent loss of explosives from the borehole.

SUMMARY OF THE INVENTION

The present invention provides a convenient, simple, safe and economic means for charging an upwardly extending borehole with bulk, flowable explosives. In accordance with the invention, a borehole plug is provided which comprises a solid, cylindrical member having a diameter substantially the same as the borehole to be charged and which is adapted to be wedged in tight-fitting position within the mouth of the said borehole, the said cylindrical member having at least one longitudinal channel therethrough, the said channel adapted to accommodate linear elements selected from flexible and inflexible conduits, detonating cords, shock tubes and electric conductors. The method of the invention comprises the steps of securing the channelled cylindrical member in the mouth of a borehole to be charged with flowable explosives, introducing bulk explosives into the borehole through a conduit within the channel while expelling displaced borehole air through a second conduit within the same or a second channel

DESCRIPTION OF THE PREFERRED EMBODIMENTS

Figure 1:
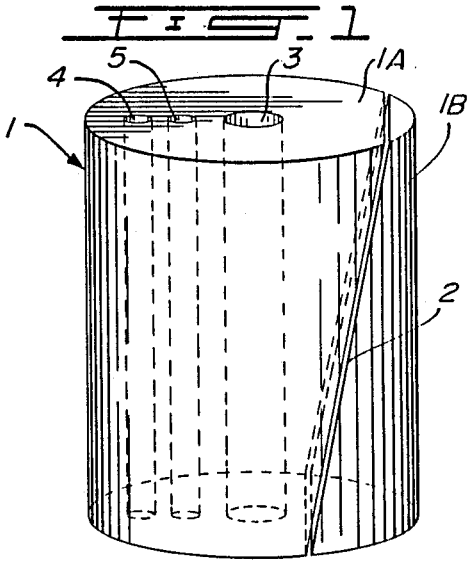
FIG. 1 is a perspective view of the borehole plug of the invention.

Referring to FIG. 1, there is shown a cylindrical borehole plug 1 which comprises two parts 1A and 1B which two parts are formed by cutting plug 1 along a longitudinal bias line 2. Parts 1A and 1B together, thus, comprise wedgeable elements. Part 1A has cylindrical channels, 3 4 and 5 longitudinally therethrough. Plug 1 is, preferably, made from rough, round timber or pole material but also may be moulded from plastic material. The diameter of plug 1 is only slightly smaller than the borehole into which it will be wedged as a stopper or plug.

Figure 2:
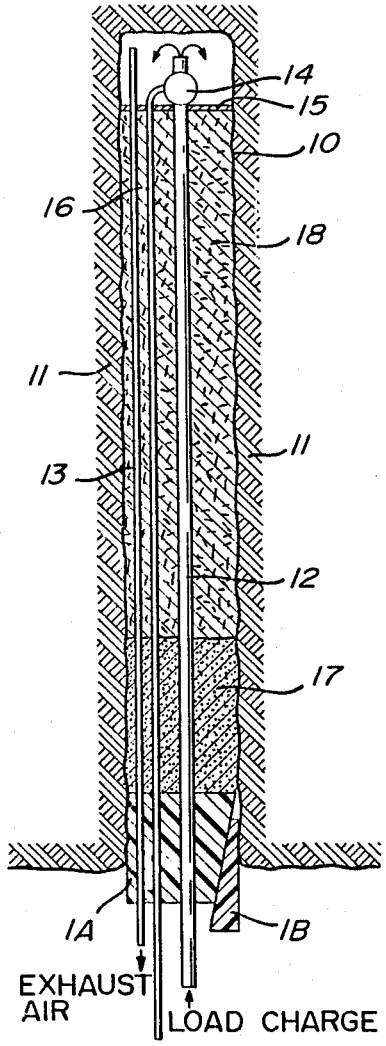
FIG. 2 shows a vertical section of a borehole in rock during the loading method of the invention.

Referring to FIG. 2, a borehole 10 is shown drilled upwardly into competent rock 11. At the mouth of borehole 10, plug 1, consisting of parts 1A and 1B, is wedged into the borehole opening in tight-fitting fashion to substantially, completely block off the borehole opening. Plug 1 is fitted with a substantially rigid conduit 12, for example, a polyethylene pipe, which is passed through channel 3 in plug 1 and which extends well into borehole 10. A second conduit 13 is passed through either channel 4 or 5 in plug 1 and extends fully to the end or toe of borehole 10. An explosive primer charge 14 is shown supported upon a perforated retaining disk element or spider 15 near the toe of borehole 10. Initiating means 16 for the primer 14, in the form of low energy cord or shock tube or electric wires, is shown passing through the remaining channel 4 or 5 of plug 1. In some instances, cord or wires 16 and conduit 13 may be accommodated in the same channel 4 or 5.

In application of the method of the invention in an underground mine, a borehole 10 of a diameter of, for example, 10 cm or more is drilled upward into the ceiling of a chamber within a competent ore body 11. Such a borehole may be from about 5 to about 30 meters in depth. A retaining element 15 is selected which element is adapted to tightly fit within the confines of borehole 10. A previously prepared primer charge 14 and its associated initiation means 16 is secured to retaining element 15 with the initiation means 16, for example, a NONEL (Reg. TM) shock tube, being sufficiently long to extend the full length of borehole 10 and to protrude therefrom. In addition, the open end of a rigid or semi-rigid tube 13, of a length greater than that of borehole 10, is also secured to element 15. Element 15 with its associated primer charge 14 and tube end 13, is pushed upward into borehole 10 by means of a lifting pole until element 15 is close to the toe end of the borehole. Alternatively, element 15 may be dispensed with in some cases and the primer charge 14, NONEL end 16 and exhaust tube 13 may be secured near the end of rigid conduit 12 by means of, for example, adhesive tape. The extending ends of NONEL 16 and tube 13 are passed through channels 4 and 5 respectively of borehole plug part 1A. Plug part 1A containing rigid conduit 12 is pressed into the mouth or opening of borehole 10 where it is wedged into a tight-fitting position by means of plug part 1B. Rigid conduit 12 is of sufficient length to extend well into the borehole 10. To charge borehole 10 with, for example, a pumpable slurry or emulsion explosive, a collar section 17 of, for example, sand, is first introduced into the borehole through rigid conduit 12. Alternatively, ammonium nitrate prills, commonly available at blasting sites for the preparation of ANFO, may be employed instead of sand. The charging of the collar section may be accomplished using conventional eductor apparatus employing readily available compressed mine air. A calculated quantity of sand or other available pulverulent material is placed on top of plug 1 to provide a complete seal for the subsequent charge of pumpable explosives and to act as borehole stemming material. After the placing of collar material 17, a delivery hose (not shown) from a fluid explosive pumping apparatus (not shown) is connected to the extended end of conduit 12 and an appropriate pre-calculated quantity of fluid explosives 18 is delivered to fill borehole 10. Air within the borehole 10 is exhausted through tubing 13 as the level of explosives rises in the borehole. When a predetermined or measured quantity of explosives has been pumped into borehole 10, the delivery hose is disconnected from conduit 12 and the charge is prepared for detonation by attaching appropriate initiation means to the exposed end of the NONEL 16.

EXAMPLE

Figure 3:
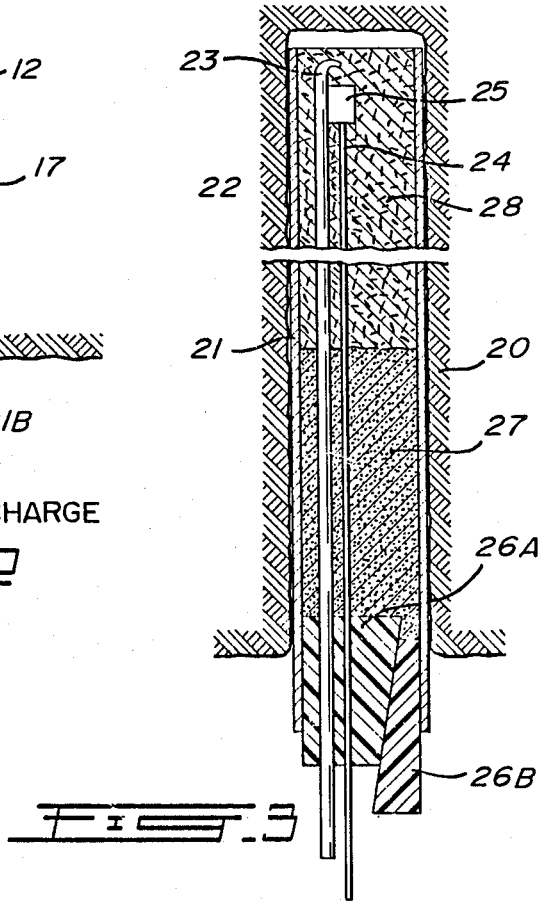
FIG. 3 shows a vertical section of a borehole in incompetent rock wherein a rigid borehole liner is used during the loading method of the invention.

In an underground mine, a series of 24 boreholes 7.6 cm in diameter were drilled upward to an average length of 9.5 meters into incompetent rock. Because of the nature of the rock, a rigid tube liner of about 7 cm outside diameter plastic pipe was inserted the full length of the borehole to prevent the inward collapse of the incompetent rock. The borehole and the loading method used are shown in FIG. 3 where the borehole is generally shown as 20 and the plastic pipe borehole liner is shown as 21. As can be seen, a narrow air space or channel is left between the borehole liner 21 and the wall of borehole 20. The sequential steps employed in charging each borehole were as follows:

(a) 1.25 cm inside diameter plastic loading pipe 22 was cut in a length less than the length of the borehole 20 and one end was fitted with a connected elbow 23.

(b) A length of detonating cord 24 slightly greater than the length of the borehole 20 was cut and inserted into a small, cast booster charge 25. The booster 25 was attached near the elbow end of loading pipe 22 by means of tape.

(c) The assembly of pipe 22, elbow 23, booster 25 and cord 24 was inserted upward into borehole 20 until approximately 0.3 meter of pipe 22 and 0.45 meter of cord 24 extended below the collar of borehole 20.

(d) The extended lengths of loading pipe 22 and cord 24 were threaded through appropriate channels in wooden plug 26A and plug 26A was inserted for about three-quarters of its length into the opening of borehole liner 21. Plug wedge 26B was hammered tightly into liner 21 to secure plug 26A in position.

(e) A sand delivery hose (not shown) was attached to the extended end of pipe 22 and a premeasured amount of dry sand was delivered by air-eduction into borehole liner 21 to provide a stemming portion 27 approximately 1.5 meters in length.

(f) An emulsion explosive delivery hose (not shown) was attached to the end of pipe 22 and emulsion explosive 28 was delivered by pump into borehole liner 21 on top of stemming sand 27 until an observed pressure increase indicated that the borehole liner 21 was completely charged with explosives. During charging, air was exhausted from the liner 21 through the narrow channel between the liner 21 and the wall of borehole 20.

(g) After explosive charging was completed, loading pipe 22 was stoppered or pinched closed to prevent any leakage of explosive. Thereafter, the charge was detonated by means of a detonator (not shown) attached to the extended end of cord 24.

(h) The charged boreholes were blasted simultaneously in groups of six with excellent fragmentation results. The material of construction of the plug 1 is, preferably, wood since round timbers of appropriate size are, generally, available at or near most mine sites. The channels 3, 4 and 5 and the bias cut 2 can conveniently be made in the mine workshop. Alternatively, plugs of various sizes may be premoulded from various plastic materials, such as, for example, foamed polyurethane. The conduit 12 is most conveniently rigid plastic pipe, such as, polyethylene pipe of a diameter of about 2.5 cm. The exhaust air tubing 13 is conveniently flexible polythene tubing of about 1 cm diameter. The retaining element 15 when employed, is common mining apparatus normally employed to maintain packaged explosive charges in upward extending boreholes.

The borehole charging method of the invention provides a safe, economic and convenient means for charging up-holes with flowable explosives. The method can be practised by a single operator, requires no elaborate or expensive apparatus and provides an optimum in blasting efficiency. The time-consuming and hazardous operation of charging heavy packages of explosives by hand into up-holes is eliminated and substantial cost savings may be realized.

We claim:

1. A method of loading a flowable explosive in bulk form into an upwardly extending borehole in rock, comprising:

closing the mouth of the said borehole with a tight-fitting, cylindrical borehole plug, said borehole plug containing at least one longitudinal conduit therethrough;

delivering into said borehole through the said conduit a charge of inert pulverulent material to lie upon the said borehole plug and partly occupy the said borehole;

delivering into said borehole through the said conduit a charge of flowable explosives to lie upon said pulverulent material and fully occupy the remainder of said borehole; and exhausting entrapped air from the said borehole through the said conduit during the steps of charging the said borehole with pulverulent material and flowable explosives.

2. A method as claimed in claim 1 wherein the said borehole plug conduit is fitted with an explosive charging tube extending the length of the said borehole.

3. A method as claimed in claim 1 wherein the said borehole plug conduit is fitted with an air exhaust tube extending the length of the said borehole.

4. A method as claimed in claim 1 wherein the said pulverulent material is selected from sand and particulate ammonium nitrate.

5. A method as claimed in claim 1 wherein the said flowable explosives is selected from water-gel slurries and water-in-oil emulsion explosives.

6. A method of loading and detonating a charge bf flowable, bulk explosives in an upwardly extending borehole in rock, comprising the steps of:

(a) extending into the said borehole a delivery conduit means for the conveying flowable explosives into the said borehole;

(b) extending into the full length of said borehole an exhaust conduit means for exhausting entrapped gas from said borehole;

(c) placing in the toe of said borehole a detonating booster charge;

(d) extending a linear initiation means from the said booster charge to the exit of said borehole;

(e) passing the said delivery conduit means, the said exhaust conduit means and the said linear initiation means through one or more apertures in a cylindrical borehole plug fitted tightly in the mouth of said borehole;

(f) introducing into said borehole through said delivery conduit means a measured volume of inert pulverulent stemming material;

(g) introducing into said borehole through said delivery conduit means a sufficient amount of flowable explosive to lie upon said stemming material and to fill said borehole so as to provide detonating contact with the said booster charge; and (h) detonating the said explosive by means of said booster charge and associated linear initating means.

7. A method as claimed in claim 6 comprising the preliminary step of inserting a liner into the said borehole prior to loading.

* * * * *